United States Patent [19]

Reuss et al.

[11] Patent Number: 5,021,336

[45] Date of Patent: Jun. 4, 1991

[54] COLOR PHOTOGRAPHIC MATERIAL

[75] Inventors: Helmut Reuss; Bruno Mücke, both of Bergisch Gladbach; Helmut Mäder, Odenthal; Dieter Rockser, Leichlingen, all of Fed. Rep. of Germany

[73] Assignee: Agfa Gevaert Aktiengesellschaft, Leverkusen, Fed. Rep. of Germany

[21] Appl. No.: 553,351

[22] Filed: Jul. 13, 1990

Related U.S. Application Data

[63] Continuation of Ser. No. 173,802, Mar. 28, 1988, abandoned.

[30] Foreign Application Priority Data

Apr. 11, 1987 [DE] Fed. Rep. of Germany ..... 3712426

[51] Int. Cl.[5] ..... G03C 1/30; G03C 1/34

[52] U.S. Cl. ..... 430/608; 430/503; 430/621; 430/623

[58] Field of Search ..... 430/608, 621, 622, 623, 430/624, 625, 626, 503

[56] References Cited

U.S. PATENT DOCUMENTS

| | | | |
|---|---|---|---|
| T.896,043 | 3/1972 | Baden | 430/608 |
| 2,552,229 | 5/1951 | Stauffer et al. | 430/608 |
| 2,566,245 | 8/1951 | Trivelli et al. | 430/608 |
| 2,839,405 | 6/1958 | Jones | 430/608 |
| 2,935,405 | 5/1960 | Sottysiak | 430/608 |
| 3,865,598 | 2/1975 | Shiba et al. | 430/608 |
| 4,332,888 | 6/1982 | Corben | 430/611 |
| 4,536,473 | 8/1985 | Mihara | 430/608 |
| 4,618,570 | 10/1986 | Kadowaki et al. | 430/626 |

FOREIGN PATENT DOCUMENTS

| | | | |
|---|---|---|---|
| 0215410 | 11/1984 | Fed. Rep. of Germany | 430/608 |
| 2130389 | 5/1984 | United Kingdom | 430/608 |

*Primary Examiner*—Charles L. Bowers, Jr.
*Assistant Examiner*—Lee C. Wright
*Attorney, Agent, or Firm*—Connolly and Hutz

[57] ABSTRACT

Color photographic recording material containing, on a reflective layer support, at least one blue sensitive, at least one green sensitive and at least one red sensitive layer of binder containing silver halide and optionally other light insensitive layers of binder, which binder has been hardened with an instant hardener, said recording material containing either from 100 to 900 mMol of soluble chloride and from 0 to 50 mMol of soluble bromide per mole of Ag or from 0 to 600 mMol of soluble chloride and from 5 to 50 mMol of soluble bromide per mol of Ag is distinguished by an exceptionally slight storage fog.

3 Claims, No Drawings

COLOR PHOTOGRAPHIC MATERIAL

This application is a continuation of application Ser. No. 07/173,802 filed Mar. 28, 1988, now abandoned.

This invention relates to a colour photographic recording material containing, on a reflective layer support, at least one blue sensitive, at least one green sensitive and at least one red sensitive layer of binder containing silver halide and optionally other, light insensitive layers of binder, which binder has been hardened with an instant hardener.

Numerous hardeners have become known for hardening the layers of binders in colour photographic recording materials. The hardeners generally react with free amino, imino or hydroxyl groups in the proteinaceous binder with crosslinking.

The use of slowly reacting hardeners is a disadvantage in that, for example, in photographic recording materials important parameters of the cast layers change progressively in the course of storage. In particular, sensitomatic data such as the sensitivity, gradation and maximum density are liable to drift slowly and the ultimate properties of the layer or of the layer package are in many cases acquired only after a considerable time in storage. This requires more stringent testing in the production process. It is therefore very desirable to use rapid hardeners because they enable the ultimate properties of the material to be reached within a short time after casting so that the storage and waiting times required can be reduced and the time and effort spent on testing can also be reduced. Very useful rapid hardeners, hereinafter referred to as instant hardeners, are described in DE-A-22 25 230, DE-A-23 17 677 and DE-A-24 39551.

Instant hardeners are compounds which are capable of crosslinking suitable binders so rapidly that hardening has been completed to such an extent either immediately after casting or at the latest after 24 hours, preferably after 8 hours, that no further change in sensitometry or swelling of the layer package occurs as a result of the crosslinking reaction. The term "swelling" denotes the difference between the wet layer thickness and the dry layer thickness of a film subjected to aqueous processing (Photogr. Sci. Eng. 8 (1964), 275; Photogr. Sci. Eng. 16 (1972), 449).

These hardeners which react very rapidly with gelatine may be, for example, carbamoyl pyridinium salts which are presumably capable of reacting with free carboxyl groups in the proteinaceous binder so that the carboxyl groups can react with free amino groups to form peptide bonds and bring about crosslinking of the binder. Owing to this rapid action, the above mentioned instant hardeners should not be added to casting solutions containing gelatine until shortly before casting because otherwise the casting properties, in particular the viscosity of the casting solutions, would be rapidly and deleteriously affected by a premature reaction. The instant hardener is generally added to the uppermost layer (protective layer). From there, the instant hardener diffuses into the other gelatine-containing layers and crosslinks the gelatine in these layers so rapidly that hardening is virtually completed by the time the layers are dry, and the parameters which characterize the physical and photographic properties have then reached their final values.

One disadvantage of the use of instant hardeners is the increase in fogging, both in the fresh material and after storage.

It is an object of the present invention to provide a colour photographic recording material which is prepared with the use of instant hardeners but undergoes very little fogging both in the fresh state and after storage while yet retaining the advantageous sensitometric properties.

It has now surprisingly been found that this problem may be solved by adding soluble halides to the layers of the colour photographic recording material.

The present invention therefore relates to a colour photographic recording material of the type mentioned above which contains either from 100 to 900 mMol of soluble chloride and from 0 to 50 mMol of soluble bromide per mol of Ag or from 0 to 600 mMol of soluble chloride and from 5 to 50 mMol of soluble bromide per mol of Ag.

The soluble halides is preferably added to the blue sensitive layer or layers or to one or more silver halide-free layers which are adjacent to the blue sensitive layers.

The quantity of soluble chloride is preferably from 300 to 600 mMol per mol of Ag.

The instant hardener is used in a quantity of from 0.1 to 5 mMol/m$^2$, preferably from 0.5 to 1.7 mMol/m$^2$.

The soluble halides are preferably added to at least one light sensitive silver halide emulsion layer in the form of an alkali metal, alkaline earth metal or ammonium halide, e.g. $NH_4Br$, $NH_4Cl$, NaBr, NaCl, KBr, KCl or LiCl.

Compounds corresponding to the following general formulae are suitable examples of instant hardeners:

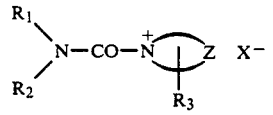

(a)

wherein $R_1$ denotes alkyl, aryl or aralkyl, $R_2$ has the same meaning as $R_1$ or denotes alkylene, arylene, aralkylene or alkaralkylene, the second bond being linked to a group of the formula

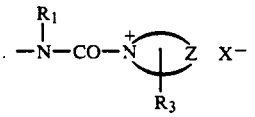

or $R_1$ and $R_2$ together represent the atoms required for completing an optionally substituted heterocyclic ring, for example a piperidine, piperazine or morpholine ring, which ring may be substituted, e.g. by $C_1$–$C_3$ alkyl or halogen, $R_3$ denotes hydrogen, alkyl, aryl, alkoxy, $NR_4$—$COR_5$, —$(CH_2)_m$—$NR_8R_9$, —$(CH_2)_n$—$CONR_{13}R_{14}$ or

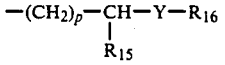

or a bridging member or a bond directly attached to a polymer chain, and $R_4$, $R_6$, $R_7$, $R_9$, $R_{14}$, $R_{15}$, $R_{17}$, $R_{18}$ and $R_{19}$ stand for hydrogen or $C_1$–$C_4$ alkyl, $R_5$ denotes hydrogen, $C_1$–$C_4$ alkyl or $NR_6R_7$, $R_8$ denotes $COR_{10}$, $R_{10}$ denotes $NR_{11}R_{12}$, $R_{11}$ denotes $C_1$–$C_4$ alkyl or aryl, in particular phenyl, $R_{12}$ denotes hydrogen or $C_1$–$C_4$ alkyl or aryl, in particular phenyl, $R_{13}$ denotes hydrogen, $C_1$–$C_4$ alkyl or aryl, in particular phenyl, $R_{16}$ denotes hydrogen, $C_1$–$C_4$ alkyl, $COR_{18}$ or $CONHR_{19}$, m denotes a number from 1 to 3, n denotes a number from 0 to 3, p denotes a number from 2 to 3 and, Y denotes O or $NR_{17}$, or $R_{13}$ and $R_{14}$ together denote the atoms required for completing an optionally substituted heterocyclic ring, for example a piperidine, piperazine or morpholine ring, which ring may be substituted, e.g. by $C_1$–$C_3$ alkyl or by halogen, Z denotes the carbon atoms required for completing a 5- or 6- membered aromatic heterocyclic ring, optionally with condensed benzene ring attached, and $X^-$ denotes an anion, which is not present if an anionic group is already attached to the remainder of the molecule;

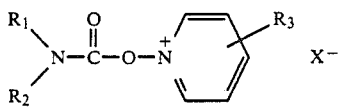

(b)

wherein $R_1$, $R_2$, $R_3$ and $X^-$ have the meanings indicated for formula (a);

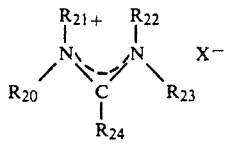

(c)

wherein $R_{20}$, $R_{21}$, $R_{22}$ and $R_{23}$ denotes $C_1$–$C_{20}$ alkyl, $C_6$–$C_{20}$ aralkyl, or $C_5$–$C_{20}$ aryl, any of which may be unsubstituted or substituted by halogen, sulpho, $C_1$–$C_{20}$ alkoxy, or N,N-Di-$C_1$–$C_4$-alkyl-substituted carbamoyl, and aralkyl and aryl groups may also be substituted by $C_1$–$C_{20}$ alkyl, $R_{24}$ denotes a group which can be split off by a nucleophilic agent, and $X^-$ has the meaning indicated for formula (a), and 2 or 4 of the substituents $R_{20}$, $R_{21}$, $R_{22}$ and $R_{23}$ together with a nitrogen atom or with the group

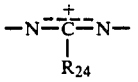

may be joined together to form one or two saturated, 5- to 7- membered rings, optionally with the inclusion of further heteroatoms such as O or N;

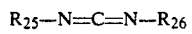

(d)

wherein $R_{25}$ denotes $C_1$–$C_{10}$ alkyl, $C_5$–$C_8$ cycloalkyl, $C_3$–$C_{10}$ alkoxy alkyl or $C_7$–$C_{15}$ aralkyl, $R_{26}$ has the same meaning as $R_{25}$ or denotes a group of the formula

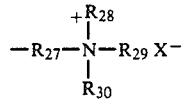

wherein $R_{27}$ denotes $C_2$–$C_4$ alkylene and $R_{28}$, $R_{29}$ and $R_{30}$ denote $C_1$–$C_6$ alkyl, and one of the groups $R_{28}$, $R_{29}$ and $R_{30}$ may be substituted by a carbamoyl group or a sulpho group and two of the groups $R_{28}$, $R_{29}$ and $R_{30}$ together with the nitrogen atom may be joined to form an optionally substituted heterocyclic ring, for example a pyrrolidine, piperazine or morpholine ring, which ring may be substituted, e.g. by $C_1$–$C_3$ alkyl or by halogen, and $X^-$ has the meaning indicated for formula (a);

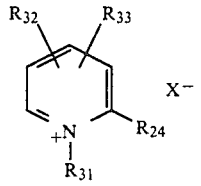

(e)

wherein $X^-$ has the meaning indicated for formula (a), $R_{24}$ has the meaning indicated for formula (c), $R_{31}$ denotes $C_1$–$C_{10}$ alkyl, $C_6$–$C_{15}$ aryl or $C_7$–$C_{15}$ aralkyl, any of which may be unsubstituted or substituted by carbamoyl, sulphamoyl or sulpho, and $R_{32}$ and $R_{33}$ denote hydrogen, halogen, acylamino, nitro, carbamoyl, ureido, alkoxy, alkyl, alkenyl, aryl or aralkyl or together they may stand for the remaining members of a ring which is condensed with the pyridinium ring, in particular a benzo ring, and $R_{24}$ and $R_{31}$ may be linked together when $R_{24}$ is a sulphonyloxy group;

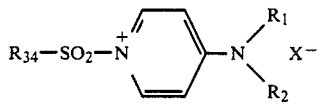

(f)

wherein $R_1$, $R_2$ and $X^-$ have the meanings indicated for formula (a) and $R_{34}$ denotes $C_1$–$C_{10}$ alkyl, $C_6$–$C_{14}$ aryl or $C_7$–$C_{15}$ aralkyl;

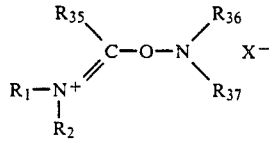

(g)

wherein $R_1$, $R_2$ and $X^-$ have the meanings indicated for formula (a), $R_{35}$ denotes hydrogen, alkyl, aralkyl, aryl, alkenyl, $R_{38}O$, $R_{39}R_{40}N$, $R_{41}R_{42}C{=}N$ or $R_{38}S$, $R_{36}$ and $R_{37}$ denote alkyl, aralkyl, aryl, alkenyl, $$R_{43}-\underset{\underset{O}{\|}}{C}-,$$

$R_{44}$—$SO_2$ or $R_{45}$—N=N— or together with the nitrogen atom they denote the remaining members of a heterocyclic ring or the group $$\begin{matrix} R_{41} \\ \diagdown \\ C{=}N- \\ \diagup \\ R_{42} \end{matrix} \text{; and}$$

$R_{38}$, $R_{39}$, $R_{40}$, $R_{41}$, $R_{42}$, $R_{43}$, $R_{44}$ and $R_{45}$ denote alkyl, aralkyl, or alkenyl and $R_{41}$ and $R_{42}$ may also denote hydrogen and $R_{39}$ and $R_{40}$ together or $R_{41}$ and $R_{42}$ together may denote the remaining members of a 5- or 6- membered saturated, carbocyclic or heterocyclic ring;

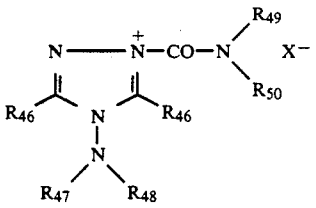

wherein $R_{46}$ denotes hydrogen, alkyl or aryl, $R_{47}$ denotes acyl, carbalkoxy, carbamoyl or aryloxycarbonyl, $R_{48}$ denotes hydrogen or $R_{47}$, $R_{49}$ and $R_{50}$ denote alkyl, aryl or aralkyl or together with the nitrogen atom they stand for the remaining members of an optionally substituted heterocyclic ring, for example a piperidine, piperazine or morpholine ring, which ring may be substituted, e.g. by $C_1$-$C_3$ alkyl or halogen, and $X^-$ has the meaning indicated for formula (a);

$$R_{51}\left[SO_2-CH{=}CH_2\right] \qquad \text{(i)}$$

wherein $R_{51}$ denotes an optionally substituted hetero aromatic ring containing at least q ring carbon atoms and at least one ring O, Ring S, or ring N atom, and q denotes an integer $\geqq 2$.

The heteroaromatic ring denoted by $R_{51}$ may be, for example, a triazole, thiadiazole, oxadiazole, pyridine, pyrrole, quinoxaline, thiophene, furan, pyrimidine, or triazine ring. In addition to the at least two vinyl sulphonyl groups, it may contain further substituents and optionally condensed benzene rings which may in turn be substituted. Examples of heteroaromatic rings ($R_{51}$) are shown below:

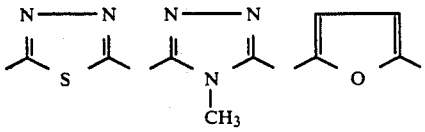

-continued

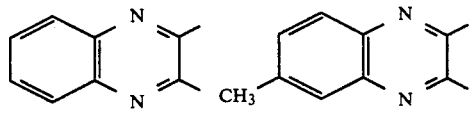

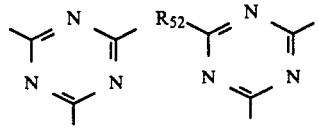

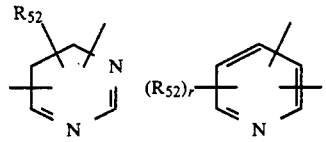

wherein r denotes a number from 0 to 3 and $R_{52}$ denotes $C_1$-$C_4$ alkyl, $C_1$-$C_4$ alkoxy or phenyl.

Suitable instant hardeners are also the compounds described in Japanese Specifications Nos. 38 540/75, 93 470/77, 43 353/81 and 113 929/83 and in U.S. Pat. No. 3,321,313.

The alkyl groups are in particular $C_1$-$C_{20}$ alkyl groups optionally substituted by halogen, hydroxy, sulpho or $C_1$-$C_{20}$ alkoxy unless otherwise defined.

The aryl groups, unless otherwise defined, are in particular $C_6$-$C_{14}$ aryl groups, optionally substituted by halogen, sulpho, $C_1$-$C_{20}$ alkoxy or $C_1$-$C_{20}$ alkyl. Aralkyl groups, unless otherwise defined, are in particular $C_7$-$C_{20}$ aralkyl groups substituted by halogen, $C_1$-$C_{20}$ alkoxy, sulpho or $C_1$-$C_{20}$ alkyl. The alkoxy groups are in particular $C_1$-$C_{20}$ alkoxy groups unless otherwise defined.

$X^-$ is preferably a halide ion such as $Cl^-$ or $Br^-$ or $BF_4$—, $NO_3^-$, $(SO_42^-)_{\frac{1}{2}}$, $ClO_4^-$, $CH_3OSO_3^-$, $PF_6^-$ or $CF_3SO_3^-$.

Alkenyl is in particular a $C_2$-$C_{20}$ alkenyl; alkylene is in particular a $C_2$-$C_{20}$ alkylene; arylene is in particular phenylene; aralkylene is in particular benzylene and alkaralkylene is in particular xylylene.

Suitable nitrogen-containing ring systems denoted by Z are shown on the previous page. The pyridine ring is preferred.

$R_{36}$ and $R_{37}$ together with the nitrogen atom to which they are attached may denote in particular a pyrrolidine or piperidine groups having 2 oxo groups attached in the o- and o'-position which ring may be benzo-, cyclohexeno- or (2,2,1)-bicyclohexeno condensed.

Acyl is in particular $C_1$-$C_{10}$ alkyl carbonyl or benzoyl; carbalkoxy is in particular $C_1$-$C_{10}$ alkoxy carbonyl; carbamoyl is in particular mono- or di-$C_1$-$C_4$-alkyl amino carbonyl, and carbaroxy is in particular phenoxy carbonyl.

The groups $R_{24}$ which are capable of being split off by nucleophilic agents may be, for example, halogen atoms, $C_1$-$C_{15}$ alkyl sulphonyl oxy groups, $C_7$-$C_{15}$ aralkyl sulphonyl oxy groups, $C_6$-$C_{15}$ aryl suphonyl oxy groups or 1-pyridinyl groups.

Preferred hardeners are shown below:

Compounds corresponding to the formula (a):

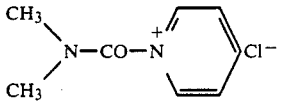
Syrup, highly hygroscopic
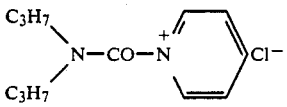
Syrup, highly hygroscopic
3
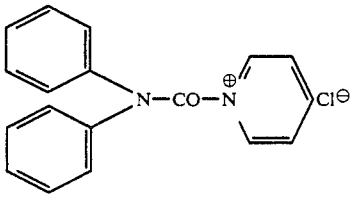
m.pt. 112° C.
4
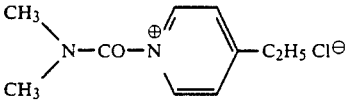
m.pt. 103° C.
5
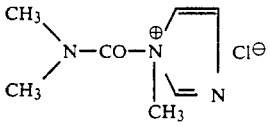
m.pt. 87-89° C.
6
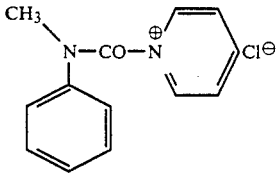
m.pt. 108-110° C.
7
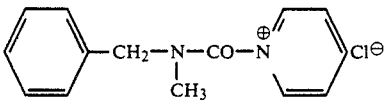
Syrup, hygroscopic
8
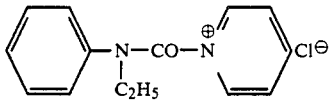
m.pt. 105-107° C.
9
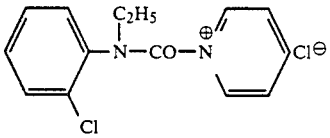
Syrup
-continued
10
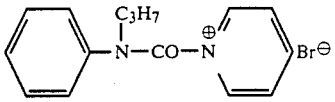
m.pt. 103-105° C.
11
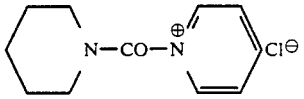
m.pt. 75-77° C.
12
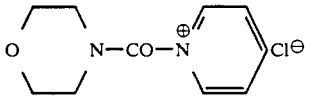
m.pt. 110-112° C.
13
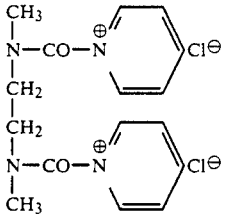
m.pt. 95-96° C.
14
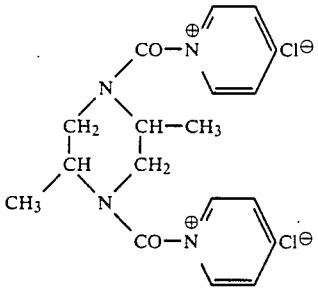
m.pt. 106° C.
15
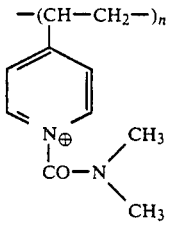
mol. wt. above 10 000
16
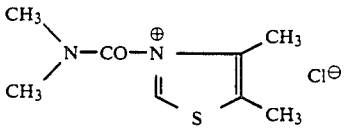
m.pt. 66-68° C.
17
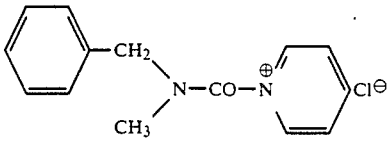

-continued
18
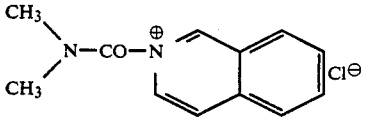
Oil
19
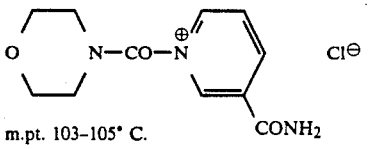
m.pt. 103-105° C.
20
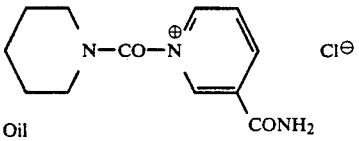
Oil
21
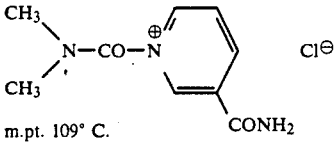
m.pt. 109° C.
22
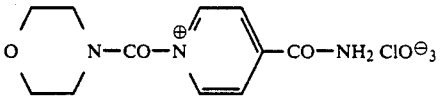
23
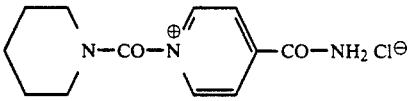
Oil
24
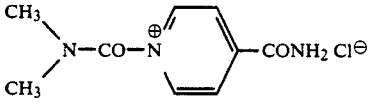
m.pt. 115° C.
25
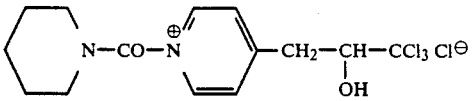
m.pt. 154° C.
26
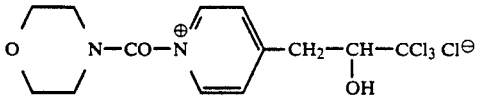
m.pt. 140° C.
27
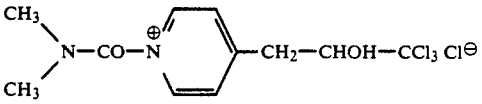
m.pt. 115° C.
28
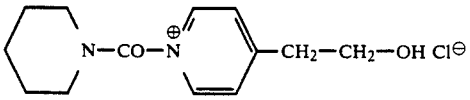
-continued
29
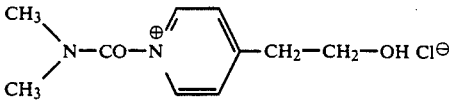
m.pt. 140° C.
30
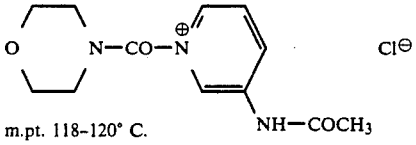
m.pt. 118-120° C.
31
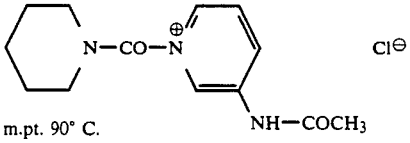
m.pt. 90° C.
32
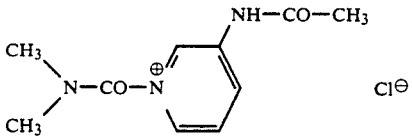
m.pt. 210° C.
33
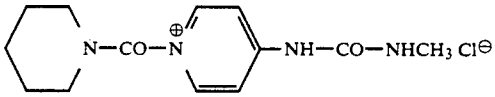
Oil
34
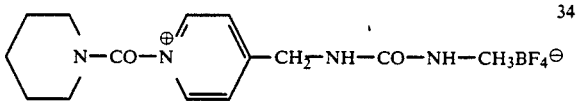
Oil
35
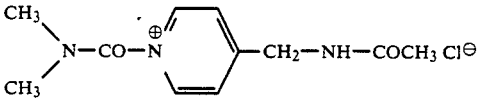
Oil
36
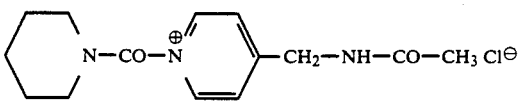
Oil
37
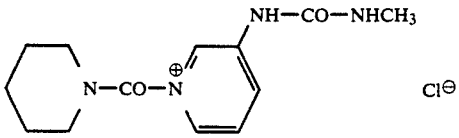
m.pt. 60-65° C.
38
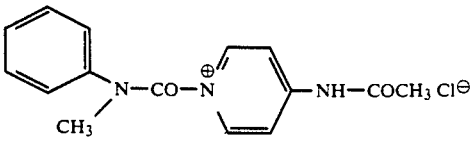

-continued
39
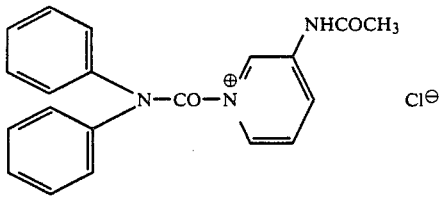
40
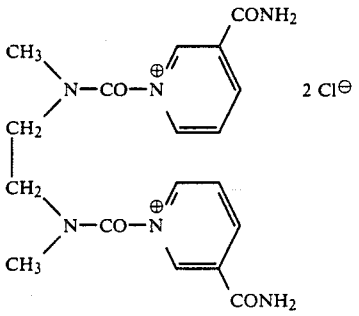
41
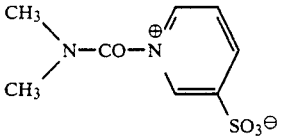
42
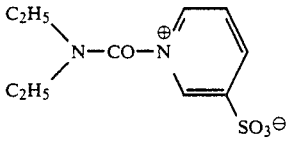
43
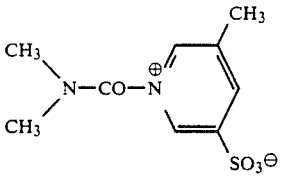
44
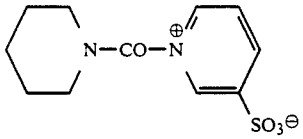
45
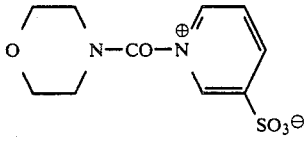
46
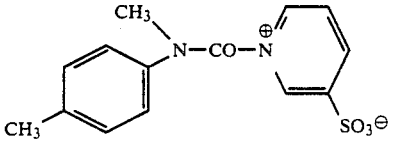
47
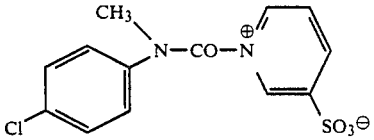
-continued
48
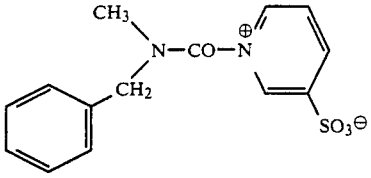
49
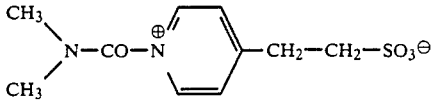
50
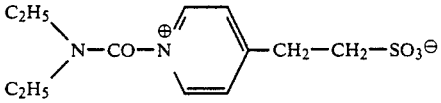
51
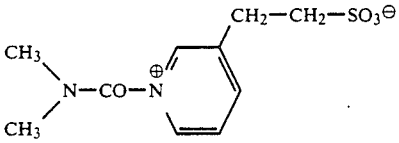
52
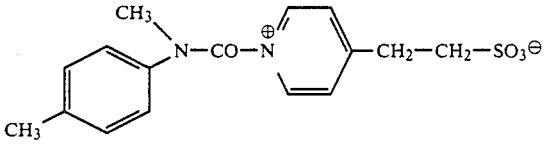
53
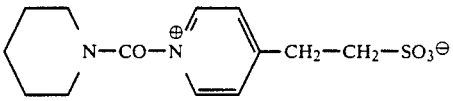
54
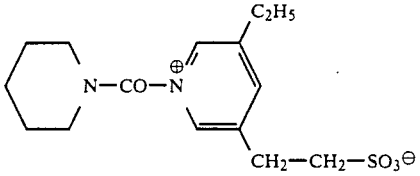
55
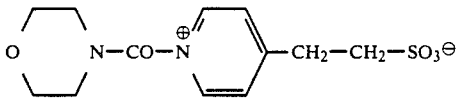
56
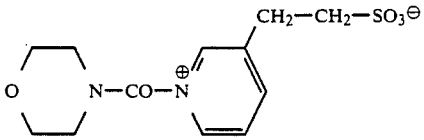
57
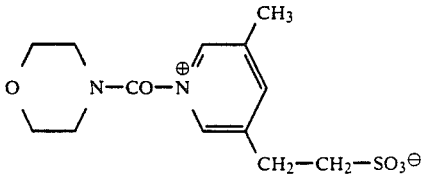
58
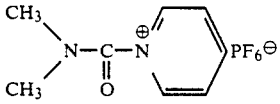

-continued

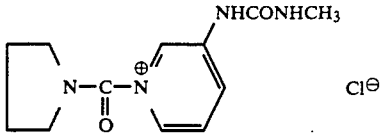

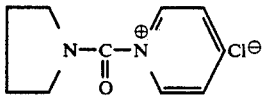

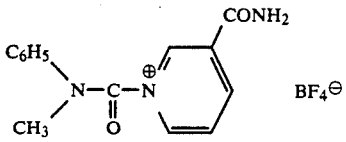

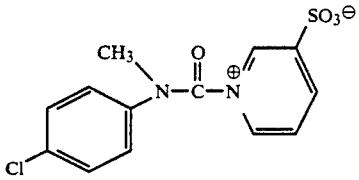

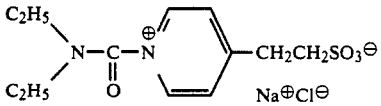

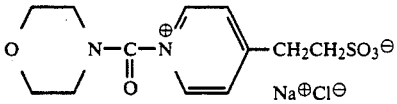

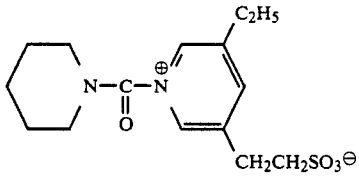

The compounds may be prepared by simple methods known from the literature. Carbamic acid chlorides, for example, may be prepared from the secondary amines by reaction with phosgene, and these carbamic acid chlorides are then reacted with aromatic, heterocyclic nitrogen-containing compounds with exclusion of air. The preparation of compound 3 is described in Chemische Berichte 40, (1907), Page 1831. Other methods of synthesis are given in DE-OS No. 2 225 230, DE-OS No. 2 317 677 and DE-OS No. 2 439 551.

Compounds corresponding to formula (b):

Processes for the synthesis of these compounds are described, for example, in DE-A-2 408 814:

| | | |
|---|---|---|
| 66 | 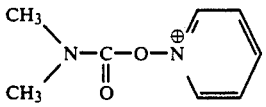 | $Cl^{\ominus}$ |
| 67 | 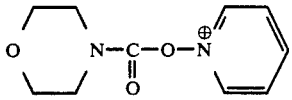 | $Cl^{\ominus}$ |
| 68 | 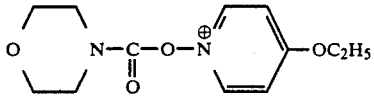 | $ClO_4^{\ominus}$ |
| 69 | 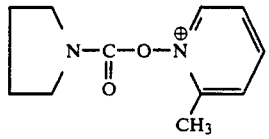 | $Cl^{\ominus}$ |
| 70 | 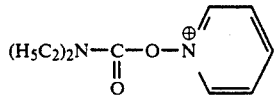 | $Cl^{\ominus}$ |

Compounds corresponding to formula (c):

Methods for the synthesis for these compounds are described in detail in Chemistry Letters (The Chemical Society of Japan), Pages 1891–1894 (1982). Further methods of synthesis are found in EP-A-162 308.

| | | |
|---|---|---|
| 71 | 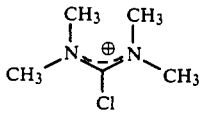 | $Cl^{\ominus}$ |
| 72 | 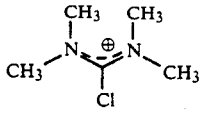 | $PF_6^{\ominus}$ |
| 73 | 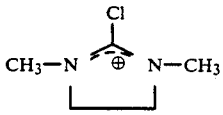 | $PF_6^{\ominus}$ |
| 74 | 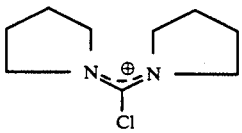 | $BF_4^{\ominus}$ |
| 75 | 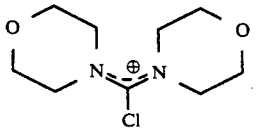 | $Cl^{\ominus}$ |
| 76 | 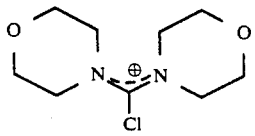 | $BF_4^{\ominus}$ |

-continued

77 $PF_6^{\ominus}$

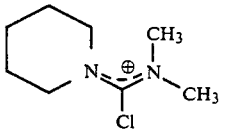

78 $CF_3SO_3^{\ominus}$

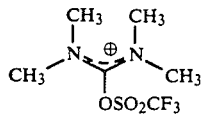

Compounds corresponding to formula (d):

Methods for the synthesis of these compounds are described in detail in Japanese Specifications Nos. 126 125/76 and 48 311/77.

79 $Cl^{\ominus}$

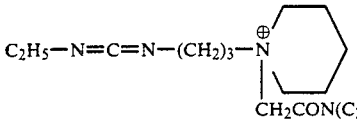

80 $Cl^{\ominus}$

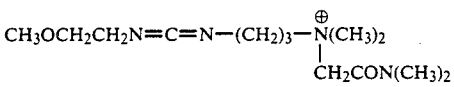

81

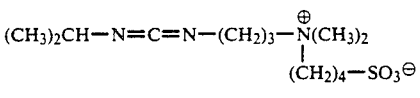

82

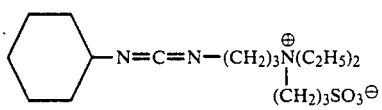

83

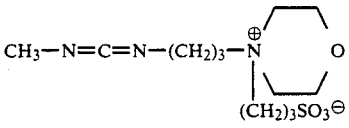

84 $Cl^{\ominus}$

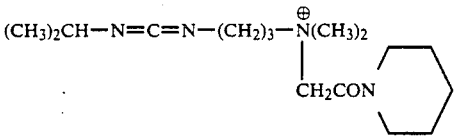

85

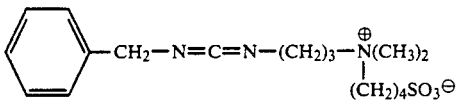

Compounds corresponding to formula (e):

Methods for the synthesis of these compounds are described in JP-OS Nos. 44 140/82 and 46 538/82 and in JP-PS No. 50 669/83.

86 $ClO_4^{\ominus}$

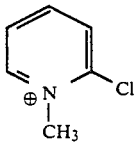

87 $Cl^{\ominus}$

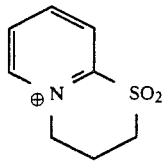

88 $Cl^{\ominus}$

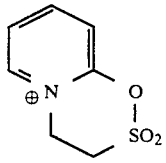

89

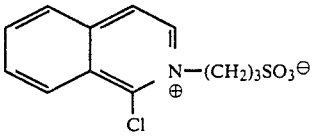

90 $Cl^{\ominus}$

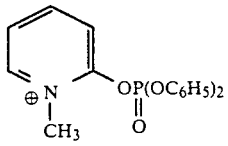

91 $I^{\ominus}$

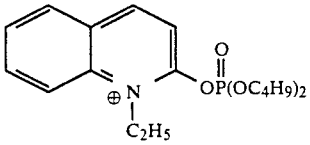

Compounds corresponding to formula (f):

Methods for the synthesis of these compounds are described in detail in JP-OS No. 54 427/77.

92 $Cl^{\ominus}$

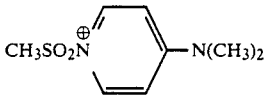

93 $Cl^{\ominus}$

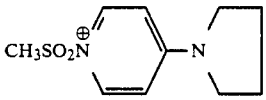

94 $Cl^{\ominus}$

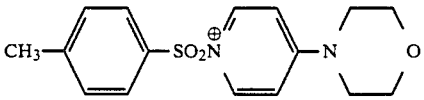

Compounds corresponding to formula (g):

The synthesis of these compounds is described in U.S. Pat. No. 4,612,280.

95 $PF_6^{\ominus}$

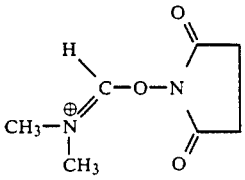

-continued
96 $BF_4^{\ominus}$
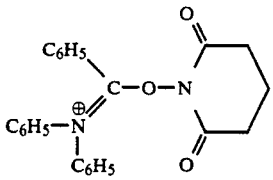
97 $BF_4^{\ominus}$
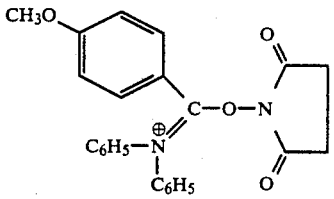
98 $PF_6^{\ominus}$
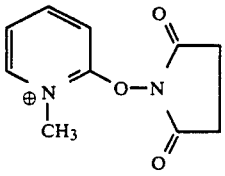
99 $BF_4^{\ominus}$
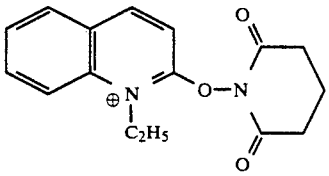
100
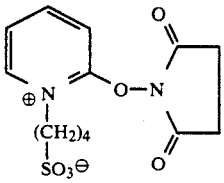
101 $Cl^{\ominus}$
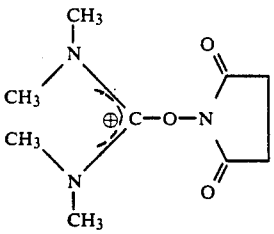
102 $BF_4^{\ominus}$
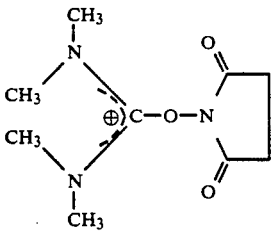
103 $PF_6^{\ominus}$
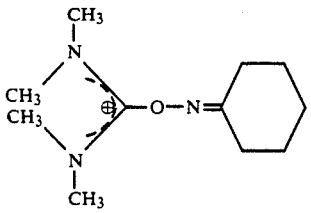
104 $BF_4^{\ominus}$
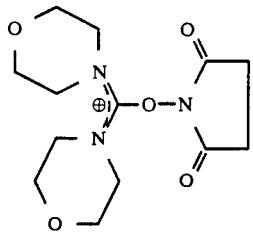
105 $BF_4^{\ominus}$
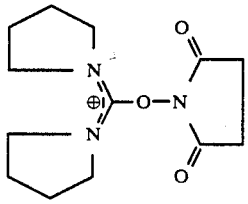
106 $PF_6^{\ominus}$
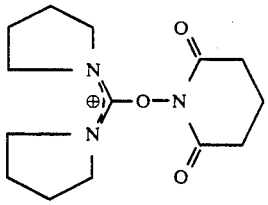
107 $PF_6^{\ominus}$
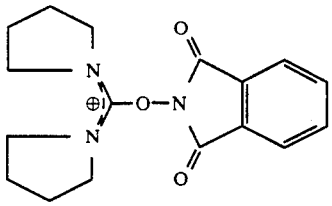
108 $PF_6^{\ominus}$
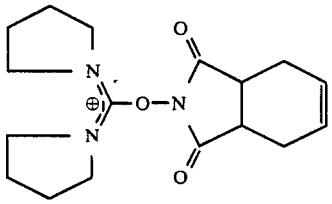
109 $PF_6^{\ominus}$
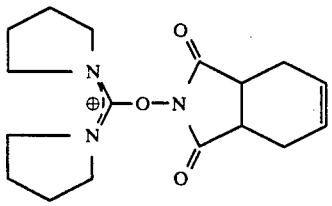
110 $PF_6^{\ominus}$
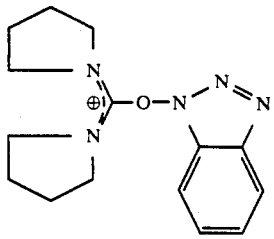

-continued

111 $BF_4^{\ominus}$

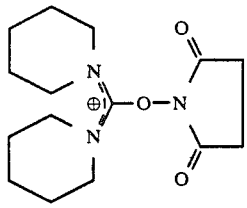

112 $PF_6^{\ominus}$

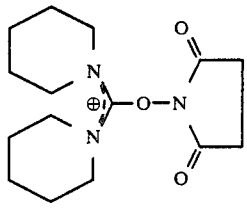

113 $SO_3^{\ominus}$

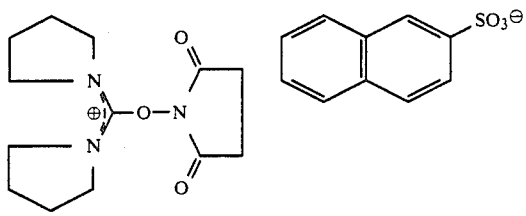

114 $PF_6^{\ominus}$

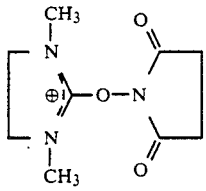

115 $BF_4^{\ominus}$

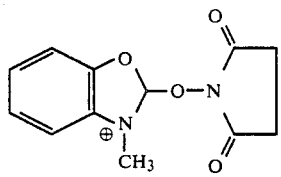

116 $PF_6^{\ominus}$

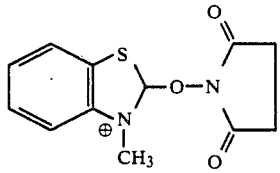

117

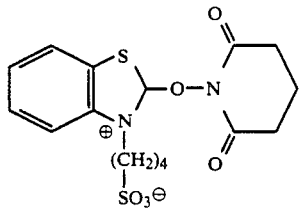

Compounds corresponding to formulae (h):

The preparation of these compounds is described in DD No. 232 564 A 1.

118 $BF_4^{\ominus}$

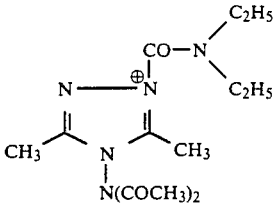

119 $Cl^{\oplus}$

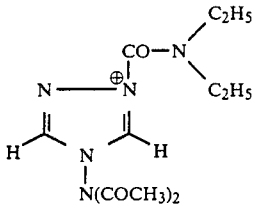

120 $ClO_4^{\ominus}$

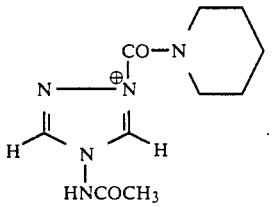

121 $BF_4^{\ominus}$

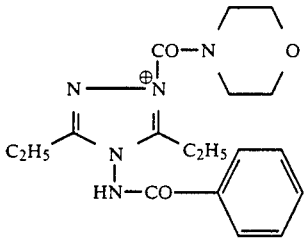

122 $BF_4^{\ominus}$

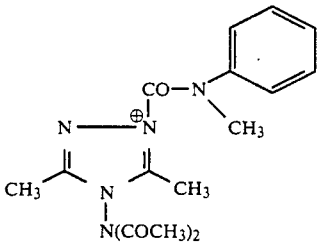

123 $BF_4^{\ominus}$

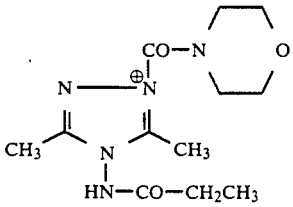

Compounds corresponding to formula (i):

Methods for the preparation of these compounds are described in DE-OS No. 35 23 360.

124

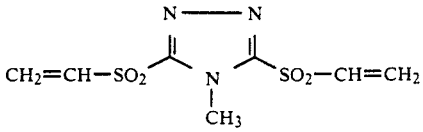

-continued
125
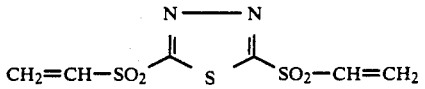
126
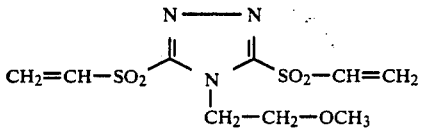
127
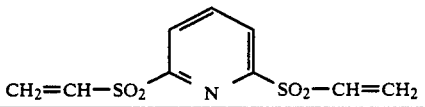
Other suitable instant hardeners correspond to the following formulae:
128
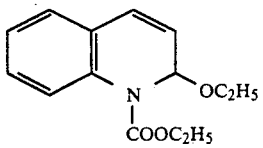
129
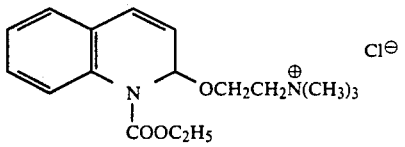
130
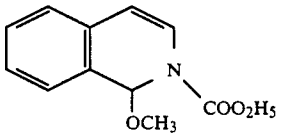
(JP-OS 38 540/75)
131
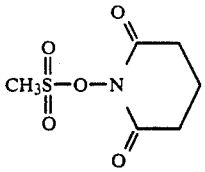
132
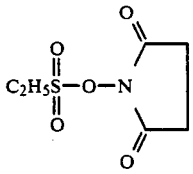
(JP-OS 93 470/77)
133
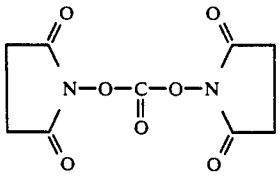
-continued
134
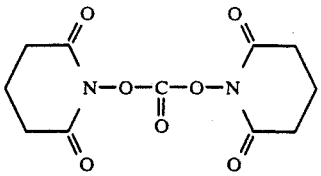
135
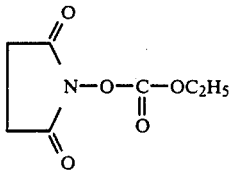
(JP-OS 43 353/81)
136
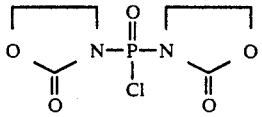
137
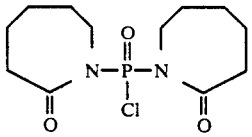
(JP 113 929/83)
138
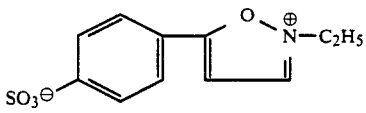
139
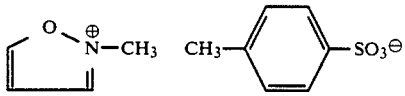
140
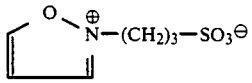
141
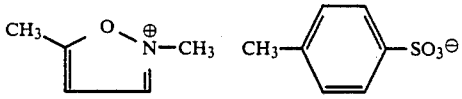
142
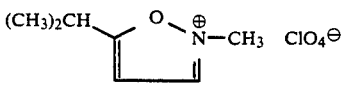
143
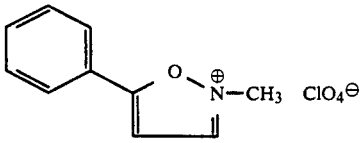
144
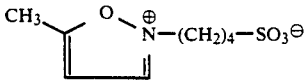
(US-PS 3 321 313)
Compounds (a) are particularly preferred.

The binders in the layers which are to be hardened by the hardening process according to the invention is a proteinaceous binder containing free amino groups and free carboxyl groups. Gelatine is a preferred example. In photographic recording materials, gelatine is the main binder used for the light sensitive substances, colour producing compounds and optionally other additives. Such recording materials frequently comprise a large number of different layers. Hardening by means of instant hardener is in most cases carried out by applying an excess of hardener as the last layer on the layers to be hardened, the solution containing the hardener which is to be applied as the coating optionally containing other substances, such as UV absorbents, antistatic agents, matting agents and polymeric organic particles.

The layer containing the hardener may be applied simultaneously with or after casting of the other layers, using a cascade or curtain caster. The casting temperature employed may vary within a wide range, e.g. from 45° to 5° C., preferably from 38° to 18° C.

The thickness of the cast hardening layer may be, for example, from 0.2 to 2.5 μm. Other additives, such as UV absorbents, colour correction dyes, anti-static agents and inorganic or organic solid particles which may be used, for example, as matting agents or spacers, may be added to the layer containing the hardener. Suitable UV absorbents are described, for example, in U.S. Pat. No. 3,253,921, DE-C-20 36 719 and EP-A-0 057 160.

Compounds suitably used in the form of inorganic solid particles are, for example, silicone dioxide, magnesium dioxide, titanium dioxide and calcium carbonate. Materials of this type are frequently used to render the outermost layers of photographic recording materials matt and thereby prevent stickiness. Solid particles of an organic nature, which may be soluble or insoluble in alkalis, are also suitable for this purpose. Such particles, also referred to as spacers, generally roughen the surface and may thereby modify the surface characteristics, in particular the tendency of the surface to stick or to slide. Polymethyl methacrylate is an example of an alkali insoluble spacer. Alkali soluble spacers are described, for example, in DE-A-34 24 893. Particulate organic polymers containing reactive groups, in particular groups capable of reacting with the binder as described, for example, in DE-A-35 44 212, may also be added as so called hardeners.

In order to impart the required viscosity for casting to the casting solution for the partial layer containing hardener, which may contain little or no binder, thickeners should be added to this casting solution, such as polystyrene sulphonic acid or hydroxyethyl cellulose.

The colour photographic recording materials according to the present invention are multilayered materials containing several silver halide emulsion layers or emulsion layer units differing in their spectral sensitivity. The term "emulsion layer unit" denotes laminates of 2 or more silver halide emulsion layers having the same spectral sensitivity. Layers having the same spectral sensitivity need not necessarily be arranged adjacent to one another but may be separated from one another by other layers, in particular by layers having a different spectral sensitivity. The binder in these layers is generally a proteinaceous binder containing free carboxyl groups and free amino groups, preferably gelatine. In addition to the proteinaceous binder, the layer binder may contain up to 50% by weight of non-proteinaceous binder such as polyvinyl alcohol, N-vinyl pyrrolidone, polyacrylic acid and derivatives thereof, in particular copolymers or cellulose derivatives as well as gelatine derivatives.

In colour photographic recording materials, each of the above mentioned light sensitive silver halide emulsion layers or emulsion layer units has at least one colour producing compound associated therewith, generally a colour coupler which is capable of reacting with colour developer oxidation products to form a non-diffusible dye. The colour couplers are preferably non-diffusible and accommodated directly in the light sensitive layer or in close vicinity thereto. The colour couplers associated with two or more partial layers of an emulsion layer unit need not necessarily be identical, provided that they give rise to the same colour on colour development, normally a colour which is complementary to the colour of the light to which the light sensitive silver halide emulsion layers are sensitive.

The red sensitive silver halide emulsion layers therefore have at least one non-diffusible colour coupler associated therewith for producing the cyan partial colour image, generally a coupler of the phenol or α-naphthol series. Cyan couplers of the type described in U.S. Pat. Nos. 2,474,293, 2,367,531, 2,895,826, 3,772,002, EP-A-0 028 099, and EP-A-0 112 514 should be particularly mentioned as examples.

The green sensitive silver halide emulsion layers generally have at least one non-diffusible colour coupler associated with them for the production of the magenta partial colour image, normally a colour coupler of the 5-pyrazolone or the indazolone series. Cyanoacetyl compounds, oxazolones and pyrazoloazoles may also be used as magenta couplers. The magenta couplers described in U.S. Pat. Nos. 2,600,788, 4,383,027, DE-A-1 547 803, DE-A-1 810 464, DE-A-24 08 665 and DE-A-32 26 163 should be particularly mentioned as examples.

The blue sensitive silver halide emulsion layers normally have at least one non-diffusible colour coupler associated with them for producing the yellow partial colour image, generally a colour coupler containing an open chain ketomethylene group. Yellow couplers of the type described in U.S. Pat. Nos. 3,408,194, 3,933,501, DE-A-23 29 587, and DE-A-24 56 976 should be particularly mentioned as examples.

Colour couplers of these types are known in large numbers and have been described in numerous patent specifications. In addition, reference may be made, for example, to the publication "Farbkuppler" by W. Pelz in "Mitteilungen aus den Forschungslaboratorien der Agfa, Leverkusen/München", Volume III (1961), Page 111 and the publication by K. Venkataraman in "The Chemistry of Synthetic Dyes", Vol. 4, 341 to 387, Academic Press (1971).

The colour couplers may be 4-equivalent couplers or 2-equivalent couplers. The 2-equivalent couplers are derived, as is known, from 4-equivalent couplers in that they contain in the coupling position a substituent which is split off in the coupling reaction. 2-equivalent couplers include both couplers which are virtually colourless and those which have an intense colour of their own which disappears in the process of colour coupling to be replaced by the colour of the image dye produced (masking couplers). Also to be included among the 2-equivalent couplers are the known white couplers which give rise to mainly colourless products in their reaction with colour developer oxidation products. The 2-equivalent couplers also include couplers which contain, in the coupling position, a releasable group which is released in the reaction with colour developer oxidation products to develop a particular photographic activity, e.g. as development inhibitor or accelerator, either directly or after one or more groups have been split off from the original releasable group (see e.g. DE-A-27 03 145, DE-A-28 55 697, DE-A-31 05 026, and DE-A-33 19 428). Examples of such 2-equivalent couplers include the known DIR couplers as well as DAR couplers and FAR couplers.

Suitable DIR couplers are described, for example, in GB-A-953 454, DE-A-1 800 420, DE-A-20 15 867, DE-A-24 14 006, DE-A-28 42 063 and DE-A-34 27 235.

Suitable DAR couplers and FAR couplers are described, for example, in DE-A-32 09 110, EP-A-0 089 834, EP-A-0 117 511, and EP-A-0 118 087.

Since the DIR, DAR and FAR couplers are required mainly for the activity of the group which is released in the coupling reaction and less for the colour producing properties of these couplers, it is equally suitable to use DIR, DAR or FAR couplers which give rise to mainly colourless products in the coupling reaction, as described, for example, in DE-A-1 547 640.

The releasable group may be a ballast group so that the reaction with colour developer oxidation products gives rise to coupling products, e.g., dyes, which are capable of diffusion or at least have a slight, if limited mobility, for example as described in U.S. Pat. No. 4,420,556.

High molecular weight colour couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-0 027 284 and U.S. Pat. No. 4,080,211. The high molecular weight colour couplers are generally prepared by the polymerisation of ethylenically unsaturated, monomeric colour couplers, but they may also be obtained by polyaddition or poly-condensation.

In addition to the constituents mentioned above, the layers of the colour photographic material which is to be hardened by the process according to the invention may contain other additives, as, for example, anti-oxidants, dye stabilizers and substances which influence the mechanical and electrostatic properties. Compounds which absorb UV light may also be added to the layers to be hardened in order to reduce or prevent the harmful effect of UV light on the colour images produced with the colour photographic recording material according to the invention.

EXAMPLE 1

A layer support of paper coated with polyethylene on both sides was covered with the layers described below. The quantities given are based on 1 $m^2$.

1. A substrate layer of 200 mg of gelatine with the addition of $KNO_3$ and chrome alum.

2. An adhesive layer of 320 mg of gelatine.

3. A blue sensitive silver chlorobromide emulsion layer (20 mol % of chloride) containing 450 mg of $AgNO_3$ with 1600 mg of gelatine, 1.0 mmol of yellow coupler, 27.7. mg of 2.5-dioctyl-hydroquinone and 650 mg of tricresyl phosphate.

The emulsion was prepared by double inflow to produce particles measuring 0.8 μm and was floculated in the usual manner, washed and redispersed with gelatine. The ratio by weight of gelatine to silver (as $AgNO_3$) was 0.5. The emulsion was then ripened to optimum sensitivity with 60 μmol of thiosulphate per mol of Ag and sensitized to the blue region of the spectrum and stabilized.

4. An interlayer of 1200 mg of gelatine, 80 mg of 2,5-dioctyl hydroquinone and 100 mg of tricresyl phosphate.

5. A green sensitive silver chlorobromide emulsion layer (20 mol % chloride) of 530 mg of $AgNO_3$ containing 750 mg of gelatine, 0.625 mmol of magenta coupler, 118 mg of α-(3-t-butyl-4-hydroxyphenoxy)-myristic acid ethyl ester, 43 mg of 2,5-dioctyl hydroquinone, 343 mg of dibutylphthalate and 43 mg of tricresyl phosphate.

6. An interlayer of 1,550 mg of gelatine, 285 mg of a UV absorbent corresponding to the following formula:

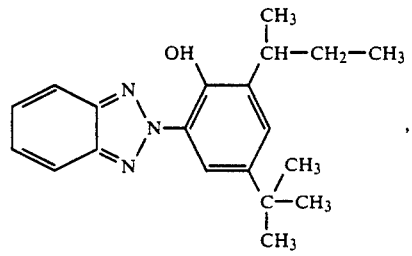

80 mg of dioctyl hydroquinone and 650 mg of tricresyl phosphate.

7. A red sensitive silver chlorobromide emulsion layer (20 mol % chloride) of 400 mg of $AgNO_3$ containing 1470 mg of gelatine, 0.780 mmol of cyan coupler, 285 mg of dibutyl phthalate and 122 mg of tricresyl phosphate.

8. A protective layer of 1200 mg of gelatine, 134 mg of a UV absorbent as used in the 6th layer and 240 mg of tricresyl phosphate.

9. A hardening layer of 400 mg of gelatine and 400 mg of hardener corresponding to the following formula:

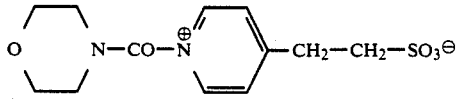

The following compounds were used as colour couplers:

Yellow coupler:

-continued

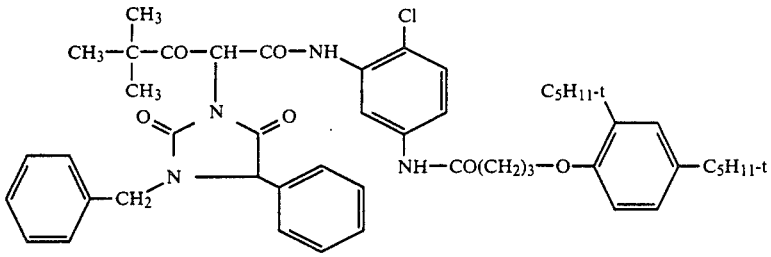

Magenta coupler:

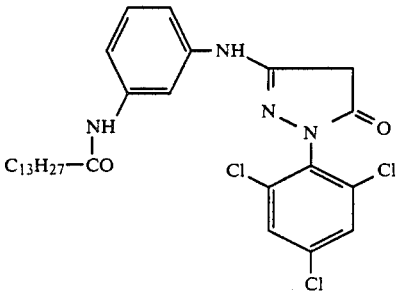

Cyan coupler:

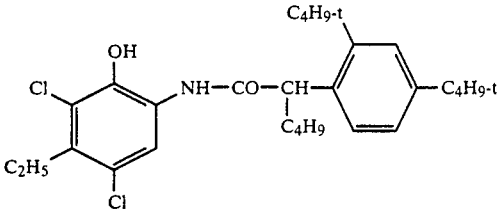

The material obtained was described as sample 1 (comparison). Another material was prepared in analogous manner, but in this case 37 mMol of KBr per mol of Ag were added to the blue sensitive emulsion after sensitization and stabilization (sample 2).

As will be seen from the following table, fogging of the blue sensitive layer in the fresh sample and especially in the sample after storage are considerably reduced by the measures according to the invention.

EXAMPLE 2

A material was prepared as in Example 1(sample 1) but 10 mMol of KBr per mol of Ag were added to the blue sensitive emulsion after sensitization and stabilization.

In addition, 10 mMol of KBr per mol of Ag were added to the green sensitive emulsion after sensitization and stabilization (sample 3).

| Sample | mMol KBr/Mol Ag | E Fresh Log I.t | Dmin × $10^{-3}$ | 6 months storage Dmin × $10^{-3}$ | Dmin × $10^{-3}$ |
|---|---|---|---|---|---|
| 1 | 0 | 2,200 | 118 | 150 | 32 |
| 2 | 37 | 2,150 | 115 | 134 | 19 |
| 3 | 20 | 2,170 | 116 | 136 | 20 |

EXAMPLE 3

A layer support of paper coated with polyethylene on both sides was covered with the layers described below. The quantities given are based on 1 $m^2$.

1. A substrate layer of 200 mg of gelatine with the addition of $KNO_3$ and chrome alum.

2. An adhesive layer of 320 mg of gelatine.

3. A blue sensitive silver chloride emulsion layer of 700 mg of $AgNO_3$ containing 1600 mg of gelatine, 1.4 mmol of yellow coupler and 900 mg of tricresyl phosphate.

The emulsion was prepared by double inflow to produce particles measuring 0.8 μm and was floculated in the usual manner, washed and redispersed with gelatine. The ratio by weight of gelatine to silver (as $AgNO_3$) was 0.5. The emulsion was then ripened to optimum sensitivity with sulphur and gold compounds, sensitized to the blue spectral region and stabilized.

4. An interlayer of 1,200 mg of gelatine, 80 mg of 2,5-dioctyl-hydroquinone and 80 mg of tricresyl phosphate.

5. A green sensitive silver chloride emulsion layer of 500 mg of $AgNO_3$ containing 980 mg of gelatine, 0.700 mmol of magenta coupler, 132 mg of α-(3-t-butyl-4-hydroxyphenoxy)-myristic acid ethyl ester, 48 mg of 2,5-dioctyl-hydroquinone, 384 mg of dibutyl phthalate and 48 mg of tricresyl phosphate.

6. An interlayer of 1,550 mg of gelatine, 285 mg of UV absorbent, 80 mg of dioctyl hydroquinone and 650 mg of tricresyl phosphate.

7. A red sensitive silver chloride emulsion layer of 300 mg of $AgNO_3$ with 850 mg of gelatine, 0.900 mmol of cyan coupler, 330 mg of dibutylphthalate and 140 mg of tricresyl phosphate.

8. A protective layer of 800 mg of gelatine, 134 mg of UV absorbent and 240 mg of tricresyl phosphate.

9. A hardening layer of 400 mg of gelatine and 300 mg of hardener.

The colour couplers, UV absorbents and hardeners used were the same compounds as in Example 1.

The material obtained was described as sample 1(comparison). Another material was prepared in analogous manner but with the addition of 580 mMol of NaCl/per mol of Ag to the blue sensitive emulsion after sensitization and stabilization, (sample 2). The table shows that fogging of the fresh sample and of the stored sample are reduced by the measure according to the invention.

| Sample | mMol NaCl/ Mol Ag | $E_{fresh}$ log I.t | $D_{min}$ fresh $\times 10^{-3}$ | 1 Months Storage $D_{min} \times 10^{-3}$ | $\Delta D_{min}$ |
|---|---|---|---|---|---|
| 1 | 0 | 1.95 | 150 | 160 | 10 |
| 2 | 580 | 1.90 | 135 | 137 | 2 |

We claim:

1. Color photographic recording material containing on a reflective layer support at least one blue-sensitive at least one green-sensitive and at least one red-sensitive layer of binder containing silver halide and optionally other light-insensitive layers of binder, in which the binders are hardened with an instant hardener, the blue-sensitive layer or layers or one or more silver halide-free layers adjacent to the one or more than one blue-sensitive layer containing a soluble halide selected from the group consisting of alkali metal chloride, alkali metal bromide, ammonium chloride and ammonium bromide in an amount of from 100 to 900 mMol of soluble chloride and from 0 to 50 mMol of soluble bromide per Mol of Ag or from 0 to 600 mMol of soluble chloride and from 5 to 50 mMol of soluble bromide per Mol of Ag.

2. A color photographic recording material as claimed in claim 1 wherein said one or more than one blue-sensitive layer contains from 300 to 600 mMol of soluble chloride per mol of silver.

3. A color photographic recording material as claimed in claim 1 wherein said binders are hardened with an instant hardener in a quantity of from 0.1 to 5 mMol/$m^2$.

* * * * *